US007188460B2

(12) United States Patent
Rozenfeld

(10) Patent No.: US 7,188,460 B2
(45) **Date of Patent: *Mar. 13, 2007**

(54) HIGH SPEED VACUUM SYSTEM FOR INSERTERS

(75) Inventor: Boris Rozenfeld, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/316,716

(22) Filed: Dec. 22, 2005

(65) Prior Publication Data

US 2006/0130436 A1 Jun. 22, 2006

Related U.S. Application Data

(63) Continuation of application No. 10/248,223, filed on Dec. 30, 2002, now Pat. No. 6,978,583.

(51) Int. Cl.
*B65B 43/26* (2006.01)
*B65B 5/10* (2006.01)

(52) U.S. Cl. ..... 53/381.6; 53/284.3

(58) Field of Classification Search ..... 53/381.5, 53/381.6, 381.7, 284.3, 457, 460, 492
See application file for complete search history.

(56) References Cited

U.S. PATENT DOCUMENTS

| | | | | |
|---|---|---|---|---|
| 4,551,188 | A * | 11/1985 | Schulze | 53/381.7 |
| 4,674,258 | A * | 6/1987 | Ehlscheid et al. | 53/381.7 |
| 5,247,780 | A * | 9/1993 | Kulpa et al. | 53/381.5 |
| 5,428,944 | A * | 7/1995 | Belec et al. | 53/492 |
| 5,581,972 | A * | 12/1996 | Antonelli | 53/381.6 |
| 5,651,238 | A * | 7/1997 | Belec et al. | 53/381.6 |
| 5,729,954 | A * | 3/1998 | Lines et al. | 53/381.7 |
| 5,774,033 | A * | 6/1998 | Antonelli | 335/219 |
| 5,911,668 | A * | 6/1999 | Auerbach et al. | 53/381.6 |
| 6,164,043 | A * | 12/2000 | Miller et al. | 53/381.6 |
| 6,425,223 | B1 * | 7/2002 | Miller et al. | 53/381.6 |

* cited by examiner

*Primary Examiner*—Louis Huynh
(74) *Attorney, Agent, or Firm*—George M. Macdonald; Angelo N. Chaclas

(57) ABSTRACT

A vacuum release assist system for a document insertion station is described. The vacuum suction cup system is used for opening an envelope. The vacuum release assist system ensures that the suction cup is timely released during the removal of the envelope from the insertion station. In one configuration, a solenoid actuator is used to push away the envelope from the suction cup. In another configuration, a blow-off valve is used to introduce positive air pressure to timely release the suction cup.

20 Claims, 5 Drawing Sheets

HIGH SPEED VACUUM SYSTEM FOR INSERTERS

CROSS REFERENCE TO RELATED APPLICATIONS

This application is a Continuation of commonly owned, U.S. patent application Ser. No. 10/248,223, filed Dec. 30, 2002, now U.S. Pat. No. 6,978,583, which is incorporated herein by reference in its entirety.

FIELD OF THE INVENTION

The illustrative embodiments described in the present application are useful in systems including those for document insertion systems and more particularly are useful in systems including those for document insertion systems utilizing a vacuum system to lift a portion of an envelope.

BACKGROUND

Multi-station document inserting systems exist that include various stations that are configured for specific applications. Certain inserting systems, also known as console inserting machines, are manufactured to perform operations customized for a particular customer. Such machines are generally used by organizations that produce a large volume of mailings in which the content of each mail piece may vary.

Examples of multi-station document inserter systems are the 8 Series TM inserter systems operating at throughputs of up to 8,000 per hour, the 9 Series TM inserter systems operating at throughputs of up to 10,500 per hour and the APS Series TM inserter systems operating at throughputs of up to 18,000 per hour, all available from Pitney Bowes Inc. of Stamford, Conn.

In many respects the typical inserter system resembles a manufacturing assembly line. Sheets and other raw materials including other sheets, enclosures, and envelopes enter the inserter system as inputs. The different modules or workstations in the inserter system work cooperatively to process the sheets and produce finished mailpieces. The exact configuration of each inserter system depends upon the needs of the particular customer or installation. For example, a typical inserter system includes a plurality of serially arranged stations including an envelope feeder, a plurality of insert feeder stations and a burster-folder station. There is a computer generated form or web feeder that feeds continuous form control documents having control-coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents. The stack is transported to the envelope feeder-insert station where it is inserted into the envelope. A typical modern inserter system also includes a control system to synchronize the operation of the overall inserter system to ensure that the collations are properly assembled.

SUMMARY OF THE INVENTION

The present application describes several illustrative embodiments providing vacuum manipulation of envelope portions, some of which are summarized here for illustrative purposes. In one embodiment, positive air pressure is used to ensure that the vacuum cups disengage the envelope portions in a timely manner. In one embodiment, a three way valve has a common portion at a vacuum cup, one valve end operatively connected to a vacuum source and another valve end operatively connected to a source of positive pressure such as a source of compressed air. In another embodiment, a control system provides positive pressure using the blow off valve in order to separate the vacuum cup from the envelope more quickly than by only removing the vacuum source.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

Figure 1:
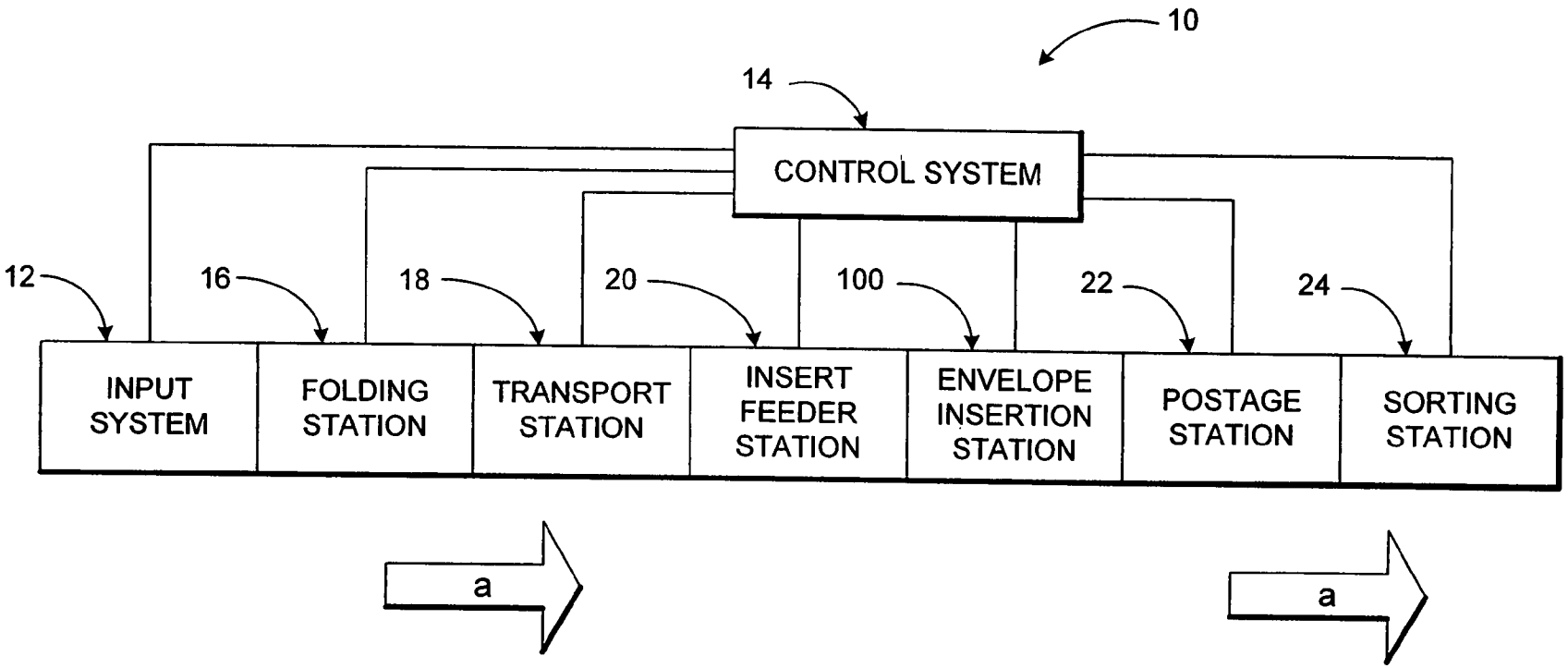
FIG. 1 is a block diagram schematic of a document inserting system having an envelope insertion station according to one illustrative embodiment of the present application.

Envelope insertion stations are important subsystems of document inserting systems. An envelope insertion device typically inserts collated enclosures into a waiting envelope. The envelope insertion device may be used with enclosures of varying thickness and with enclosures that are not significantly different in length than the length of the envelopes into which they are inserted.

Certain envelope insertion stations use continuously running transport belts on the deck of the insertion station, wherein the transport belts feed the envelope. Once the envelope is at an insertion position, a stop is used prevent the envelope from continuing with the belt. The transport belt is sliding along the underside of the envelope and friction may cause the envelope to move (jitter) while it is abutting against a stopping member waiting for the insertion of an enclosure collation. This jittering movement of the envelope may cause it to misalign with respect to an enclosure collation being conveyed toward the envelope awaiting insertion and may cause a paper jam in the insertion station.

Envelope insertion stations have been implemented with vacuum decks that stabilize an envelope while it is abutting against a stopping member. See for example commonly assigned U.S. Pat. No. 5,428,944, incorporated herein by reference. Such a vacuum deck may impede the forward travel of an envelope once the stopping members are moved.

Envelope insertion stations have been implemented with a system for transporting, de-skewing and stopping an envelope in the envelope insertion station. See for example commonly assigned U.S. Pat. No. 5,924,265, incorporated herein by reference. One system described therein includes a plurality of laterally spaced, continuously moving, endless transport belts for conveying an envelope in the insertion station. A stationary vacuum deck is provided that includes longitudinal grooves, wherein each of the grooves accommodates an upper reach of a corresponding one of the continuous moving transport belts. The vacuum deck includes a plurality of vacuum ports arranged in longitudinal rows, wherein each of the rows is adjacent at least one of the transport belts and wherein vacuum is continuously present at each vacuum port. Also provided is a plurality of stop members located at the downstream end of the vacuum deck wherein vacuum at the vacuum ports urge an envelope against the continuously moving transport belts that transport the envelopes to the stop members.

The envelope insertion stations described herein are illustrative and other systems may be used. For example, commonly owned, co-pending U.S. patent application Ser. No. 10/280,170, entitled Envelope Transport Module With Vacuum Ports For Use in An Envelope Inserting Machine, filed Oct. 25, 2002, is incorporated herein by reference and describes an alternative insertion system that may be utilized.

An envelope insertion system may also utilize vacuum in pick-up cups that are used to lift a portion of an envelope in order to hold open the envelope as it is being stuffed with inserts.

Referring to FIG. 1, a schematic of a document inserting system according to one embodiment of the present application is shown. The document inserting system 10 includes an insertion station 100. The document insertion system 10 is illustrative and many other configurations may be utilized.

System 10 includes an input system 12 that feeds paper sheets from a paper web to an accumulating station that accumulates the sheets of paper in collation packets. Preferably, only a single sheet of a collation is coded (the control document), which coded information enables the control system 14 of inserter system 10 to control the processing of documents in the various stations of the mass mailing inserter system.

Input system 12 feeds sheets in a paper path, as indicated by arrow "a," along what is known as the main deck of inserter system 10. After sheets are accumulated into collations by input system 12, the collations are folded in folding station 16 and the folded collations are then conveyed to a transport station 18, preferably operative to perform buffering operations for maintaining a proper timing scheme for the processing of documents in insertion system 10.

Each sheet collation is fed from transport station 18 to insert feeder station 20. It is to be appreciated that an inserter system 10 may include a plurality of feeder stations, but for clarity, only a single insert feeder 20 is shown. Insert feeder station 20 is operational to convey an insert (e.g., an advertisement) from a supply tray to the main deck of inserter system 10 so as to be combined with the sheet collation conveying along the main deck. The sheet collation, along with the nested insert(s), are next conveyed into envelope insertion station 100 that is operative to first open the envelope and then insert the collation into the opening of the envelope. The envelope is then conveyed to postage station 22. Finally, the envelope is conveyed to sorting station 24 that sorts the envelopes in accordance with postal discount requirements.

Figure 2:
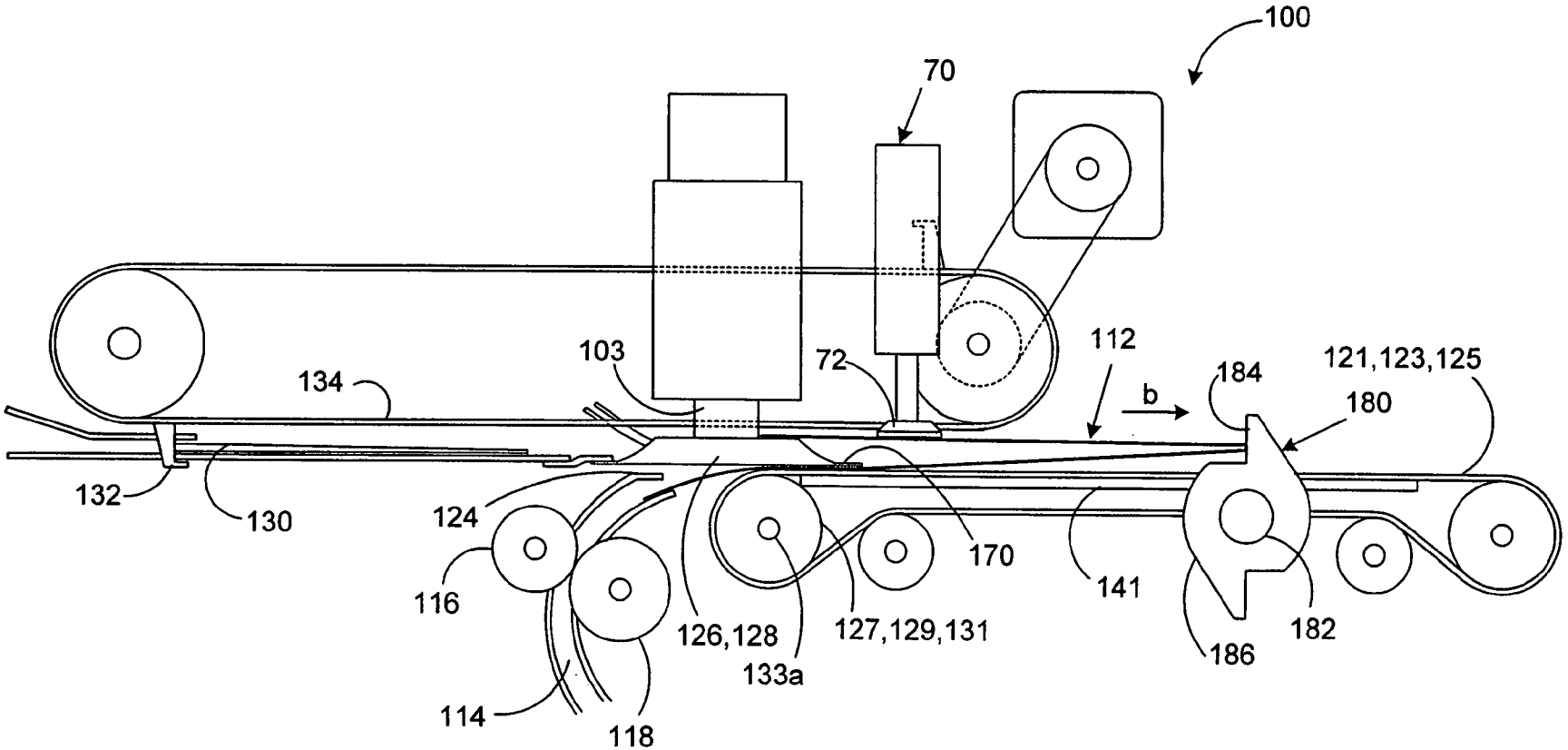
FIG. 2 is a side elevational view of a document inserter with vacuum cup in a first position according to another illustrative embodiment of the present application.

Referring now to FIG. 2, an insertion device 100 according to an illustrative embodiment of the present application is shown. For clarity, FIG. 2 depicts an insertion station 100 without illustrating any enclosure collations or envelopes. In operation, an envelope enters the insertion station 100 along a guide path 114 and is transported into the insertion station 100 by a set of transport rollers 116 and 118 and continuously running transport belts 121, 123 and 125. Each transport belt 121, 123 and 125 respectively wraps around rollers 127, 129 and 131, each roller being connected to a common shaft 133*a*. Each transport belt 121, 123 and 125 is juxtaposed between deck strips that form transport deck 141 of insertion station 100.

The motion of each transport belt 121, 123 and 125 is continuous for maintaining registration of an envelope 112 against a backstop 180. Continuous vacuum from each of the deck strips via their respective vacuum plenums prevents any jiggling of the envelope even though the transport belts 121, 123 and 125 are continuously running beneath.

Rotating backstop members 180 are preferably located outside the vacuum deck strips in an elongate slot. Each backstop member 180 is concentrically mounted about a common shaft 182 for effecting rotation thereof. Each stopping portion 184 is configured to stop an envelope when it is above the deck 141 of insertion station 100. A servo motor (not shown) causes rotation of the backstops members 180 about axle 182.

Insertion station 100 includes envelope flap retainers 124 and rotating insertion horns 126 and 128 each having an underside that assists in helping an envelope conform to each transport belt 121, 123 and 125 while not presenting any catch points for the leading edge of the enclosure collation 130 to be inserted in a waiting open envelope 112. The horns 126 and 128 are supported from above the envelope path and are eccentrically mounted on pivot shafts 103. They are positioned perpendicular to the path of the envelope travel as the envelope is conveyed to backstop members 180. Once the vacuum assembly 70 has begun to open the envelope, the insertion horns 126 and 128 pivot into the envelope and continue their pivoting motion until the extreme edges of the envelope have been shaped and supported by the profile of each horn 126 and 128. Rotating insertion horns 126 and 128 perform the additional function of centering envelope 112 in the path of the oncoming enclosure collation 130. At this time an oncoming enclosure collation 130 may be introduced and pushed through the insertion horns 126 and 128 into a waiting envelope 112. The pivot shaft of each insertion horn 126 and 128 is driven by a servo motor (not shown).

Insertion station 100 further includes an envelope opening vacuum assembly 70 for separating the back panel of an envelope from its front panel. Vacuum assembly 70 is perpendicular to the transport deck 141 of insertion station 100. Vacuum assembly 70 includes a reciprocating vacuum cup 72 that translates vertically downward toward the surface of the transport deck 141 and then upward away from the transport deck 141 to a height sufficient to allow a stuffed envelope to pass under. The vacuum cup 72 adheres to the back panel of an envelope, through a vacuum force present in vacuum cup 72 so as to separate the envelopes back panel away from its front panel during upward travel of the vacuum cup 72.

The enclosure collations 130 are fed into the insertion station 100 by means of a pair of overhead pusher fingers 132 extending from a pair of overhead belts 134 relative to the deck of inserter system 10. As with the envelope 112, the top side of the envelope flap retainers 124 and the associated interior of the insertion horns 126, 128 must not present any catch points for the leading edge of the enclosure collation 130.

Referring to FIG. 2, a method of operation according to an illustrative embodiment of the present application is described. An envelope 112 is conveyed to the transport deck 141 of insertion station 100 via guide path 114 (which is in connection with an envelope supply (not shown)). Once a portion of the envelope 112 contacts the continuous running transport belts 121, 123 and 125, these transport belts convey envelope 112 downstream as indicated by arrow B, in insertion station 100. Concurrently, each deck strip of transport deck 141 provides a continuous vacuum force upon envelope 112 (via vacuum plenums) so as to force envelope 112 against the continuous running transport bets 121, 123 and 125. Next, an elongate stopping portion 184 of backstop member 180 is caused to extend above the transport deck 141 at a height sufficient to stop travel of the envelope 112 in insertion station 100. The leading edge of the envelope 112 then abuts against the stopping portion 184 of backstop member 180 so as to prevent further travel of the envelope 112.

While the envelope 112 is abutting against the stopping portion 184 of backstop member 180, the transport belts 121, 123 and 125 are continuously running beneath the envelope 112. To prevent jiggling of the envelope 112 (as could be caused by the friction of continuous running transport belts 121, 123 and 125) the continuous vacuum force applied to the envelope 112 by the deck strips functions to stabilize the envelope 112 on the transport deck 141 while it is abutting against backstop member 180.

When envelope 112 is disposed in insertion station 100, the vacuum cup 72 of vacuum assembly 70 is caused to reciprocate downward toward the back panel of envelope 112. The vacuum cup 72 adheres to the back panel and then reciprocates upwards so as to separate the back panel from the envelope front panel to create an open channel in the envelope 112. Enclosure collation 130 is then conveyed toward the envelope 112 by pusher fingers 132. At first, the insertion horns 126, 128 are positioned in a first position wherein their respective stripper blade portions 170 are positioned outside of the open end of the closed envelope 112. Before the conveying enclosure collation 130 is advanced into the open channel of envelope 112, each insertion horn 126 and 128 is pivoted towards its second position, approximately 65 degrees. When pivoted the insertion horns 126 and 128 provide a guide path into the open channel of the envelope 112 into which an enclosure collation 130 travels through and into the envelope 112.

Figure 3:
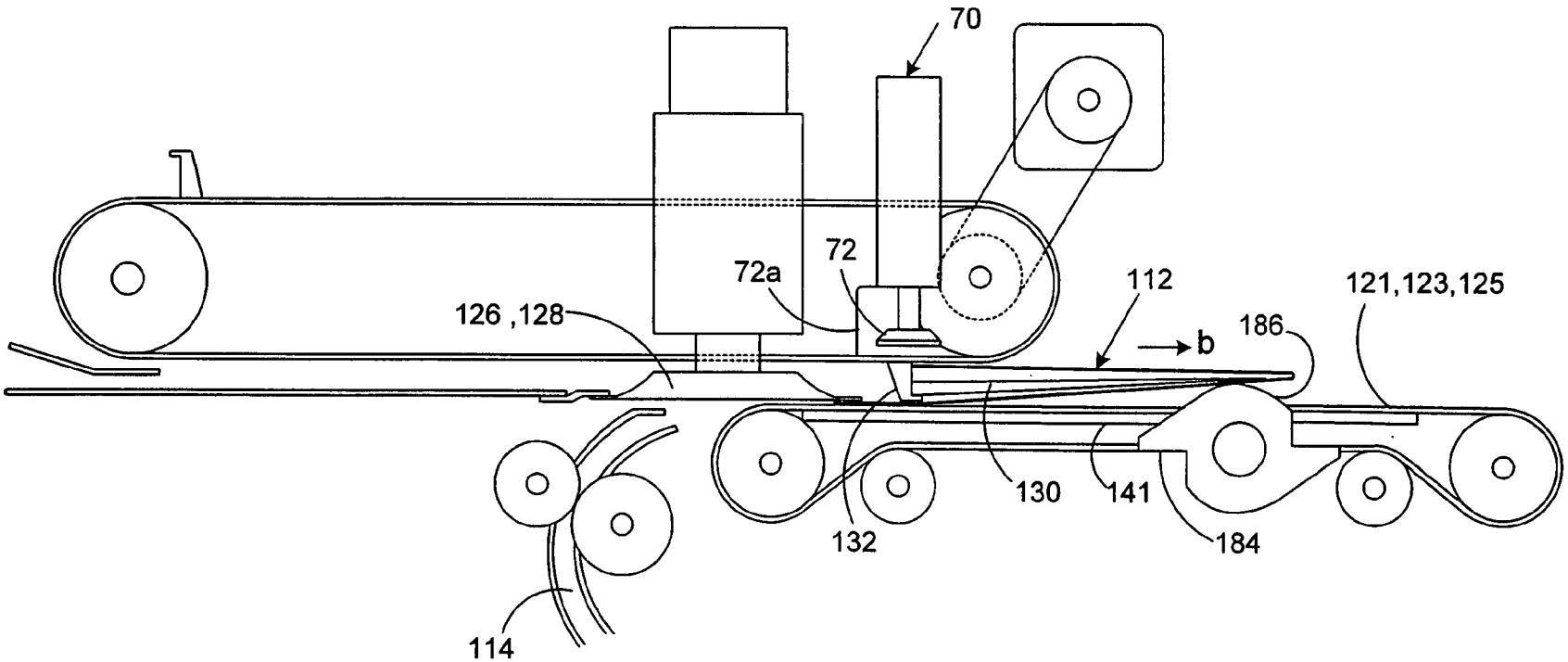
FIG. 3 is a side elevational view of a document inserter with vacuum cup in a second position according to another illustrative embodiment of the present application.

Referring to FIG. 3, after the enclosure collation 130 is inserted into the envelope 112, the insertion horns 126 and 128 are caused to pivot, preferably 65 degrees, back to the first position and the vacuum force of the vacuum cups 72 is terminated thus releasing the vacuum to the envelope back panel. Vacuum cup 72 may experience residual vacuum after the signal to turn off the vacuum is sent. For example, a 5 ms vacuum valve switching delay may be introduced and an additional 15 ms of residual vacuum may be present. As described below, a vacuum disengage assist system is used to timely disengage the vacuum cup 72 from the envelope. The backstop member 180 is then rotated approximately 90 degrees such that its elongate stopping portion 184 is caused to rotate below the top surface of the transport deck 141 and its cam portion 186 is then caused to extend above the top surface of the transport deck 141. Since the elongate stopping portion 184 is rotated below the transport deck 141, the continuous running transport belts 121, 123 and 125 once again causes the envelope 112 to convey along the transport deck 141 in the downstream direction (as indicated by arrow B).

While cam portion 186 of backstop member 180 is extending above the transport deck 141, the leading edge of the envelope 112 rides over the ellipsoid configuration of cam portion 186 causing the leading edge portion of the envelope 112 to lift away from the transport deck 141, particularly the deck strips. Since the leading edge portion of envelope 112 has lifted away from the later deck strips, this portion of the envelope also at least partially breaks its vacuum connection with the transport deck 141 enabling the envelope 112 to more quickly accelerate after the stopping portion 184 of the backstop member 180 rotates below the top surface of the transport deck 141.

The stuffed envelope is then conveyed downstream of the insertion station 100 for further processing. The above process for inserting another enclosure collation into another envelope is then repeated.

In systems running at throughput rates of approximately 18,000 per hour, the release of the vacuum and transport of the stuffed envelope out of the document inserter may be completed by the cam action. However, the envelope may be pulled in direction B while there is still at least some residual vacuum being asserted by the vacuum suction cup 72. A single vacuum cup is illustrated for clarity, however, it is expected that additional vacuum cups may be utilized. The additional friction caused by the residual vacuum holding the envelope against the vacuum cup may wear the vacuum cup. Accordingly, it may be advantageous or necessary to provide assistance in disengaging the vacuum so that the envelope can be readily removed from the insertion position.

A system such as a 22,000 throughput APS inserter system provides for vacuum opening and processing of envelopes at product throughput speeds up to 22,000 per hour. The vacuum system includes an arrangement of valves and air lines leading to pickup cups used to pick up the top panel of envelopes. A timing problem may exist at very high speeds when the envelope is being filled and when the insert must reach its intended fully loaded position inside the waiting envelope. If the vacuum is turned off upon finishing the insertion and just before the envelope moves out of the insertion area, the vacuum may not fully dissipate immediately. There may be a delay of approximately 5 ms from the time when a valve control signal is sent until the time the valve actually switches. Furthermore, there is likely a delay of approximately 15 ms for a typical vacuum level at the cup to decay from approximately 11 p.s.i. to 0 p.s.i. Because the vacuum does not dissipate instantly as a step function, there is a residual vacuum under the suction cups when the envelopes start to move. Such an effect may not be present or may not be as pronounced at lower speeds. At high speeds, the suction cups may degrade more quickly because of the increased friction from having the envelopes pulled away when there is still residual pressure. The amount of residual pressure and the timing of the events may lead to more or less friction and more or less wear on the suction cups. In one alternative, the vacuum is switched off earlier in order to account for the switch delay at the valve. Optionally, the vacuum is switched off early to enable an initial decay of vacuum pressure that is tolerable.

However, in some cases, the early removal of vacuum could lead to insertion jams at high speeds. Accordingly, a preferred embodiment uses a system of positive valves described herein as blow-off valves in which a positive pressure system is added to provide a push-off of the vacuum at the cups in a timely manner to insure that the envelope and suction cups are completely separated before the envelopes start moving. The positive air is enabled at a time in the insert loading cycle to insure that the insert is properly loaded and that the envelope held open by the suction cup is released. The suction cups may wear more slowly in such a system.

Figure 4A:
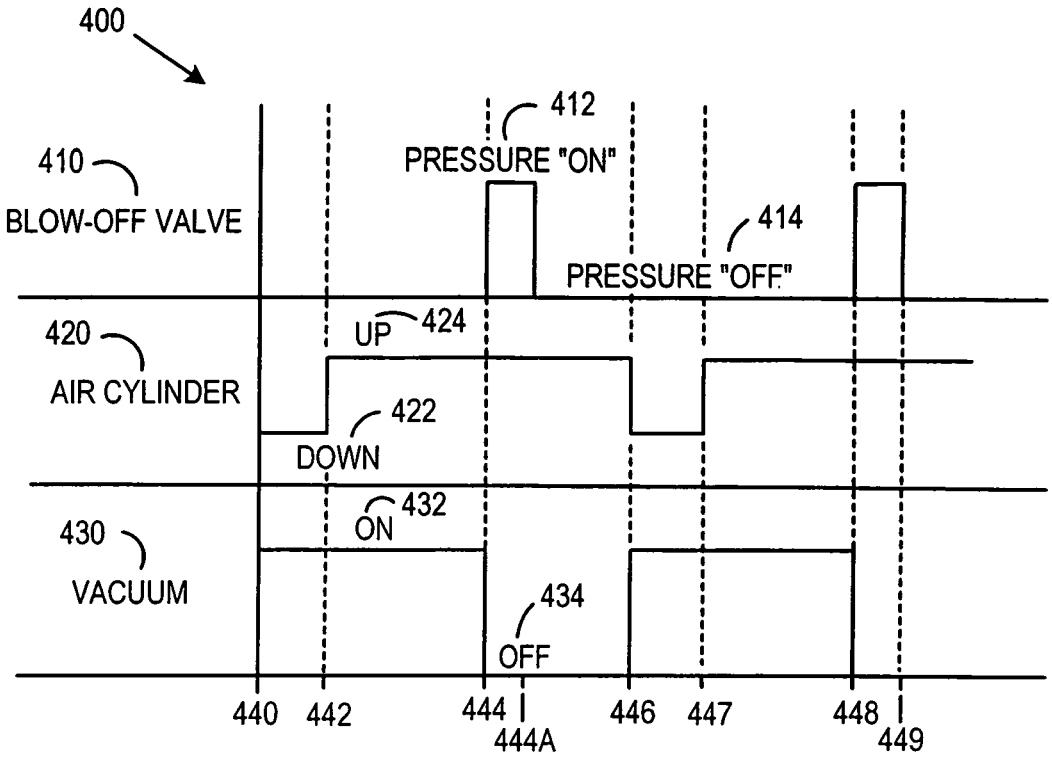
FIG. 4A is schematic diagram showing a timing relationship among vacuum and pressure application according to an illustrative embodiment of the present application.
Figure 5:
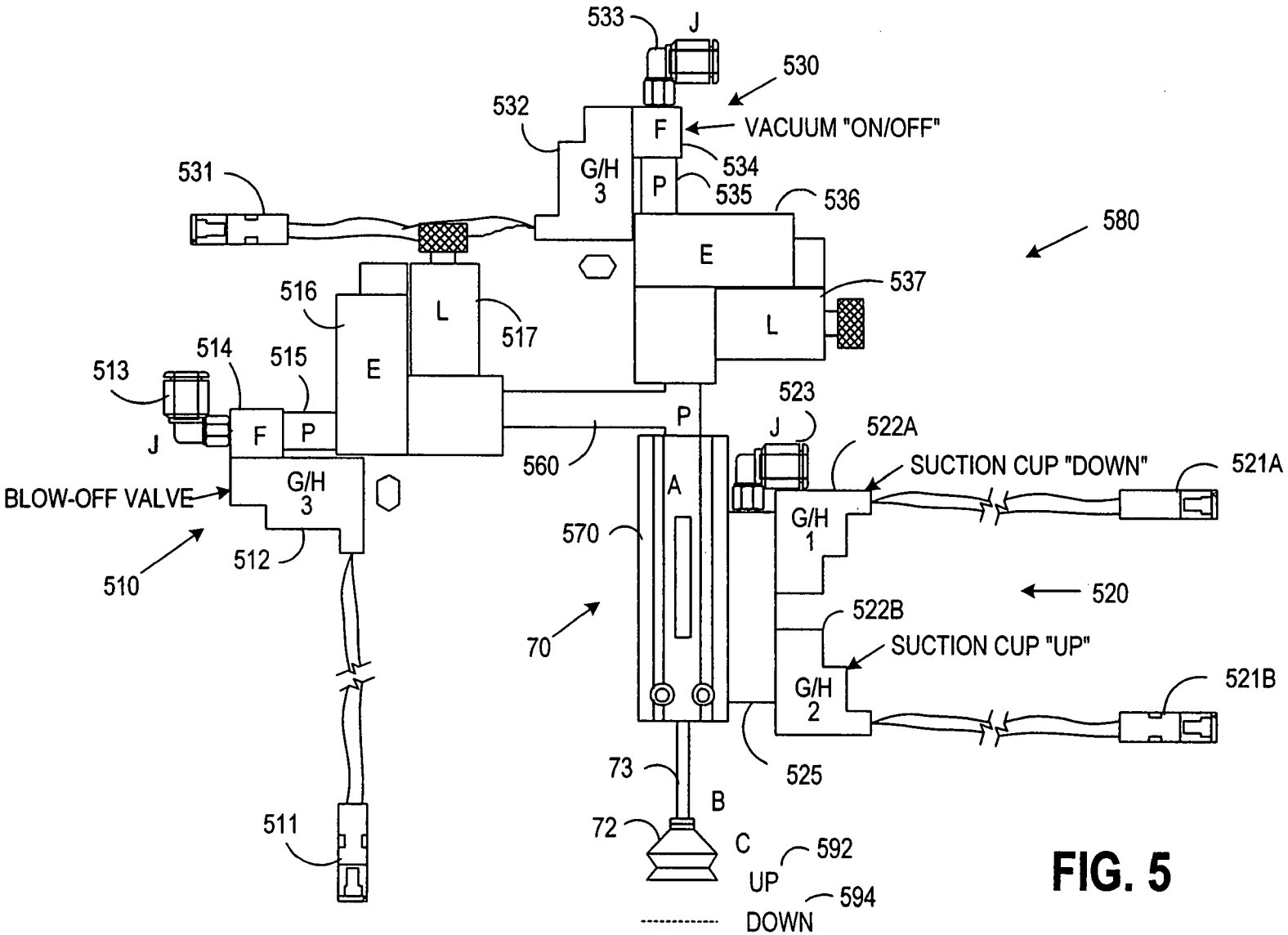
FIG. 5 is a side elevational view of a vacuum cup assembly according to an illustrative embodiment of the present application.

Referring to FIG. 4A and FIG. 5, a preferred vacuum-disengage assist mechanism is described. As shown in FIG. 5, a vacuum system 580 is shown and could be applied in any of the embodiments described including those shown in FIG. 2 and FIG. 3. Suction cup 72 is operatively connected to vacuum cup adapter 73. The vacuum cup is shown having at least two positions, the up position 592 and the down position 594. The vacuum suction cup system 70 includes an air cylinder 570, tubing 560, a suction cup movement source system 520 (521A, 521B, 522A, 522B, 523, 525), a vacuum source valve 530 (531, 532, 533, 534, 535, 536, 537) and a blow-off valve system 510 (511, 512, 513, 514, 515, 516, 517). Tubing 560 is a threaded piece of tubing used to position the valve closer to the body.

An insertion station may use two, three or other number of suction cup systems. The suction cup may act as a spring in that it pushes the envelope away, but at the same time pushes itself to the envelope to ensure that it stays in contact with the envelope when it should. The cup is a silicon suction cup that may have a useful life in an insertion system without a vacuum-disengage assist system of approximately 250,000 cycles. In a machine operating at 22,000 cycles per hour, the suction cups may wear out after approximately 11 hours. Suction cup adapter 73 includes a push on suction cup adapter section that allows the suction cups to be changed in only a few seconds. However, longer suction cup life would allow an inserter to process more cycles before a suction cup change was required. Accordingly, fewer suction cups would be used.

The suction cup movement source system 520 is used to move the suction cup assembly between at least two positions including an up position 592 and a down position 594. It includes a first control connection 521A connected to a first three-way valve with LED and surge 522A used for the suction down command. It includes a second control connection 521B connected to a first three-way valve with LED and surge 522B used for the suction up command. The suction cup source system also includes a one-touch fitting 523 for a source of air or other pneumatic means. In this illustrative embodiment, a manifold 525 is utilized so that a single source of air pressure or other pneumatic means can be used at fitting 523 instead of using two sources for the suction cup system movement system. Here, manifold 525 can supply air into both ports 522A and 522B to supply compressed air to both ports using one feed.

The vacuum source system 530 is used to turn on and off the vacuum applied to the vacuum suction cup 72. A one-touch fitting 533 is connected to a vacuum source. The system 530 includes a control connection 531 connected to a three-way valve with LED and surge 532 used for the vacuum commands. Adjustable fitting 535 is connected to the base for the VQ valve 534 and vacuum generator 536 and filter L 537. Vacuum generator/ejector 536 is preferably a Venturi vacuum generator. The filter 537 is used to filter the air coming from the vacuum of the suction cup and the air from 533 as paper dust and other contaminants may be in the air stream. For example, air into vacuum generator 536 and air from suction cup 72 are filtered in filter 537. Known vacuum generators, vacuum control valves, filters, fittings, compressed air supplies and compressed air lines are used and are not described in detail.

The blow-off valve source system 510 is used to assist in turning off the vacuum applied to the vacuum suction cup 72 in a more timely manner than if the blow-off valve was not used. A one-touch fitting 513 is connected to a vacuum source. The system 510 includes a control connection 511 connected to a three-way valve with LED and surge 512 used for the vacuum commands. Adjustable fitting 515 is connected to the base for the VQ valve 514 and vacuum generator 516 and filter L 517.

The control-signal timing diagram 400 shows an illustrative process of using the blow-off valve 410 to push the top portion of the envelope away from the vacuum cup. This positive airflow significantly reduces friction between the suction cup and the envelope exiting the insertion area. In effect, an air bearing is formed that reduces any friction between the vacuum cup and the envelope. This control switching diagram is illustrative and other timing diagrams may be used effectively to assist in disengaging the vacuum cup from the envelope. Here, a first point in time 440 is depicted on the x-axis of the timing diagram. The valves may have an actuation delay time such as 5 ms. In an alternative, the delay may be accounted for. The control signal diagrams do not necessarily represent the air levels present in the air lines at a particular time, as there may be ramp up or decay to reach pressure levels. In at least one example, adding a vacuum disengage assist system resulted in an improvement of the 20 ms decay from 11 p.s.i. to 0 p.s.i to an approximately 5 ms decay, most of which could be attributed to the valve switch delay.

The blow-off valve 410 is depicted as having at least two positions represented in timing diagram 410 as the on position 412 and the off position 414. Similarly, the air cylinder 420 that is used to move the vacuum cup is depicted with at least two positions including the up position 424 and the down position 422. As also shown in FIG. 2 and FIG. 3, the vacuum cup has at least two different positions.

The vacuum system 430 is shown having at least two states, the vacuum on state 432 and the vacuum off state 434. While the vacuum control state may be set to off, the actual vacuum may linger in a non-step function fashion causing residual friction between the vacuum cup and the envelope.

At time 440, the vacuum 430 is on, the air cylinder 420 is down and the blow-off valve 410 is off. At time 442, the air cylinder 420 controlling the height of the vacuum cup is switched from a down position to an up position. The blow-off valve 410 is off and the vacuum 430 is on.

At time 444, the air cylinder 420 remains up, but the blow-off valve 410 is switched on and the vacuum 430 is removed. Here, it is shown that the blow-off valve 410 will fire to assist the process of disengaging the top of the envelope from the vacuum cup. At time 444A, the blow-off valve 410 is switched off. Then at time 446, the air cylinder 420 is switched to a down position and the vacuum 430 is turned on to process another envelope. The air cylinder 420 is pulled up at time 447 and at time 448, the blow-off valve 410 is switched on and the vacuum 430 is turned off as described above. At time 449, the blow-off valve 410 is switched off.

The switching control diagram shown in FIG. 4A is not drawn to scale. For example, with a machine running at 22,000 cycle per hour speed, a total cycle time of 165 ms may include a typical air cylinder cycle up time of 100 ms with the rest of the cycle being down. A typical blow-off activation may be around 20–25 ms and may vary with the flap size. The air cylinder timing control settings depend upon the envelope size. The control software sets the appropriate timing parameters for the envelope size being used. The linear velocity of an envelope in such a system at 22,000 cycles may be 125 inches per second and require 2¼ to 2½ inches of travel having an air bearing created by the vacuum disengage assist system.

Figure 4B:
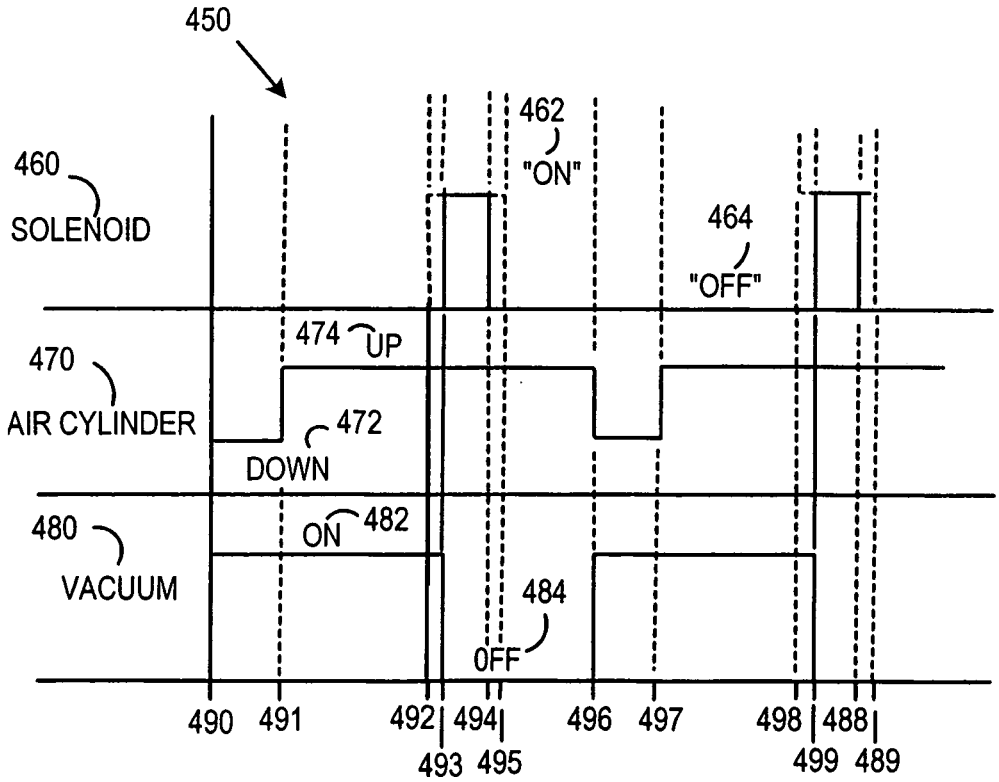
FIG. 4B is schematic diagram showing a timing relationship among vacuum and pressure application according to another illustrative embodiment of the present application using a solenoid vacuum release assist.

Referring to FIG. 4B, an alternative vacuum release assist system is shown. In this alternative vacuum release assist mechanism, an envelope vacuum-disengage system means 72*a* such as a piston or solenoid actuator is be used to break the vacuum seal in a timelier manner as shown in FIG. 2 and FIG. 4B.

The timing diagram 450 shows an illustrative process of using the solenoid actuator 72*a* to push the top portion of the envelope away from the vacuum cup. Other timing diagrams may be used effectively to assist in disengaging the vacuum cup from the envelope. Here, a first point in time 490 is depicted on the x-axis of the timing diagram.

The solenoid actuator control 460 is depicted as having at least two positions represented in timing diagram 450 as the on position 462 and the off position 464. Similarly, the air cylinder 470 that is used to move the vacuum cup is depicted with at least two positions including the up position 474 and the down position 472. As also shown in FIG. 2 and FIG. 3, the vacuum cup has at least two different positions.

The vacuum system 480 is shown having at least two states, the vacuum on state 482 and the vacuum off state 484. While the vacuum control state may be set to off, the actual vacuum may linger, causing residual friction between the vacuum cup and the envelope.

At time 490, the vacuum 480 is on, the air cylinder 470 is down and the solenoid 460 is off. At time 491, the air cylinder 470 controlling the height of the vacuum cup is switched from a down position to an up position. The solenoid 460 is off and the vacuum 480 is on.

At time 493, the air cylinder 470 remains up, but the solenoid 460 is switched on and the vacuum 480 is removed. Here, it is shown that the solenoid 460 will fire to assist the process of disengaging the top of the envelope from the vacuum cup. At time 494, the solenoid 460 is switched off. Then at time 496, the air cylinder 470 is switched to a down position and the vacuum 480 is turned on to process another envelope. The air cylinder 470 is pulled up at time 497 and at time 499, the solenoid 460 is switched on and the vacuum 480 is turned off as described above. At time 488, the solenoid 460 is switched off.

In this embodiment, the current profile used to drive the solenoid may have a different amplitude curve than the one shown in the general timing schematic as 460. Additionally, the timing diagram used may change and time 492 may be used to replace 493 in order to start the solenoid firing cycle earlier. Time 495 can replace 494 if a longer solenoid firing is required. Similarly, time 498 could replace time 499 and time 489 could replace time 488.

As discussed above, the timing diagram varies with the speed of the insertion system throughput and actual time measurements are not specified but may be determined by one of ordinary skill in the art. The control system 14 could control the insert station actions, but the envelope insertion station preferably includes a separate processor for control such as a micro controller or another processor.

In another alternative embodiment, the vacuum release assist system 72*a* may be implemented using a forced air system having a nozzle. The forced air system is then used to push the top portion of the envelope away from the vacuum cup.

In another alternative embodiment, the vacuum release assist system 72*a* may be implemented using a piezo electric actuator that is used to push the top portion of the envelope away from the vacuum cup at an appropriate time. As can be appreciated, other controllable actuators may be used.

The present application describes illustrative embodiments of a system and methods for providing a vacuum disengage assist. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. An insertion station apparatus operative to insert an enclosure collation into an open end of an envelope, the insertion station having a deck with a transport mechanism for conveying an envelope into an insertion location and then away from the insertion location, an opening mechanism for opening an envelope, the opening mechanism comprising:

a suction device operatively connected to a suction assembly, the suction assembly having a first control mechanism controlled by a first electrical control signal and a transport system for moving the suction device into at least a first position for engaging the envelope in a closed position and a second position for engaging the envelope in an open position;

the suction device for applying vacuum to a top portion of the envelope; and a vacuum disengage assist system for applying positive gas pressure while the suction device is in the second position for disengaging the vacuum applied to the top portion of the envelope wherein the positive gas pressure is removed before the suction device is moved from the second position, wherein the vacuum disengage assist system includes a second control mechanism controlled by a second electrical control signal applied before the envelope is conveyed away from the insertion station, wherein the second electrical control signal is actuated independently of the first control signal and wherein an actuation time between the actuation of the first electrical control signal and the second electrical control signal is adjustable.

2. The apparatus of claim 1 wherein:

the vacuum disengage assist system comprises a blow-off valve operatively connected to the suction device for providing positive pressure to the suction device.

3. The apparatus of claim 2 wherein:

the blow-off valve provides positive pressure for a first time interval after the vacuum is disengaged.

4. The apparatus of claim 1 wherein:

the opening mechanism further comprises a solenoid for moving an actuator to physically contact and apply force to the top portion of the envelope.

5. The apparatus of claim 4 wherein:

the solenoid is energized when the vacuum is removed.

6. The apparatus of claim 1 wherein:

the opening mechanism further comprises a nozzle for applying a forced gas stream to the top portion of the envelope at least partially during the time when the suction device is applying vacuum to the top portion of the envelope.

7. The apparatus of claim 6 wherein:

the gas is compressed air.

8. The apparatus of claim 1 wherein:

the second control mechanism responds to the second electrical control signal within a substantially fixed time period.

9. The apparatus of claim 8 wherein:

the substantially fixed time period is equal to 5 ms.

10. The apparatus of claim 1 wherein:

the opening mechanism further comprising a Venturi vacuum generator for developing vacuum applied at the suction device.

11. An insertion station apparatus operative to insert an enclosure collation into an open end of an envelope, the insertion station having a deck with a transport mechanism for conveying the envelope, an opening mechanism for opening the envelope, the opening mechanism comprising:

a suction device operatively connected to a suction assembly, the suction assembly having a transport system for moving the suction device into at least a first position and a second position;

a tube having a suction device opening, a vacuum source opening and a vacuum disengage assist system opening;

the suction device connected to the suction device opening of the tube, wherein the suction device engages a top portion of the envelope in order to apply a vacuum to the top portion of the envelope;

a vacuum source connected to the vacuum source opening of the tube for switching between a vacuum on state at a first time and a vacuum off state at a second time for applying vacuum to the top portion of the envelope and then removing vacuum to the top portion of the envelope; and a vacuum disengage assist system connected to the vacuum disengage assist system opening of the tube for providing positive pressure to the suction device for disengaging the vacuum applied to the top portion of the envelope, wherein an amount of time between the first time and the second time is adjustable.

12. The apparatus of claim 11 wherein:

wherein the vacuum disengage assist system comprises a three-way valve blow-off valve operatively connected to the suction device; and wherein the three-way valve blow-off valve provides forced gas to the suction device while the suction device is in the second position and after the vacuum source switches to the vacuum off state.

13. The apparatus of claim 12 wherein:

the three-way valve blow-off valve is sent an on signal before the vacuum source switches to the vacuum off state for reducing the effective delay of switching on the three-way valve blow off valve.

14. The apparatus of claim 13 wherein:

the on signal is sent approximately 5 ms before the vacuum source switches to the vacuum off state.

15. The apparatus of claim 12 wherein:

the blow-off valve provides positive pressure for a first time interval after the vacuum is disengaged, wherein the first time interval ends before the suction assembly switches to the first position.

16. An insertion apparatus operative to insert an item into an open end of an envelope, the insertion apparatus having a transport mechanism for conveying the envelope, an opening mechanism for opening the envelope, the opening mechanism comprising:

a suction device operatively connected to a suction assembly, the suction assembly having a transport system for moving the suction device into at least a first position and a second position;

the suction assembly having a suction device port, a vacuum source port and a vacuum disengage assist system port;

the suction device connected to the suction device port, wherein the suction device engages a top portion of the envelope in order to apply a vacuum to the top portion of the envelope;

a vacuum source connected to the vacuum source port of the suction assembly for switching between a vacuum on state at a first time and a vacuum off state at a second time for applying vacuum to the top portion of the envelope and then removing vacuum to the top portion of the envelope; and a vacuum disengage assist system connected to the vacuum disengage assist system port of the suction assembly for providing positive pressure to the suction device for disengaging the vacuum applied to the top portion of the envelope, wherein an amount of time between the first time and the second time is adjustable.

17. The apparatus of claim 16 wherein:

wherein the vacuum disengage assist system comprises a three-way valve blow-off valve operatively connected to the suction device; and wherein the three-way valve blow-off valve provides forced gas to the suction device while the suction device is in the second position and after the vacuum source switches to the vacuum off state.

18. The apparatus of claim 17 wherein:

the three-way valve blow-off valve is sent an on signal before the vacuum source switches to the vacuum off state for reducing the effective delay of switching on the three-way valve blow off valve.

19. The apparatus of claim 18 wherein:

the on signal is sent approximately 5 ms before the vacuum source switches to the vacuum off state.

20. The apparatus of claim 17 wherein:

the blow-off valve provides positive pressure for a first time interval after the vacuum is disengaged, wherein the first time interval ends before the suction assembly switches to the first position.

* * * * *